US007455551B2

(12) United States Patent
Sakamoto et al.

(10) Patent No.: US 7,455,551 B2
(45) Date of Patent: Nov. 25, 2008

(54) CONNECTOR HOUSING

(75) Inventors: Nobuyuki Sakamoto, Makinohara (JP); Yomihiko Nagayoshi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/898,018

(22) Filed: Sep. 7, 2007

(65) Prior Publication Data

US 2008/0064247 A1 Mar. 13, 2008

(30) Foreign Application Priority Data

Sep. 8, 2006 (JP) ..... 2006-243668

(51) Int. Cl.
*H01R 13/40* (2006.01)

(52) U.S. Cl. ..... 439/595

(58) Field of Classification Search ..... 439/595, 439/596, 752, 747; 264/328.1, 328.12
See application file for complete search history.

(56) References Cited

U.S. PATENT DOCUMENTS 5,120,269 A * 6/1992 Endo et al. ..... 439/752
5,256,083 A * 10/1993 Yamamoto ..... 439/595
5,683,272 A * 11/1997 Abe ..... 439/747
6,000,972 A * 12/1999 Abe ..... 439/733.1
6,165,012 A * 12/2000 Abe et al. ..... 439/596
6,319,074 B1 * 11/2001 Kashiyama ..... 439/752
6,482,035 B2 * 11/2002 Okabe et al. ..... 439/596
6,632,392 B2 * 10/2003 Kashiyama ..... 264/328.1
7,374,463 B2 * 5/2008 Kuo ..... 439/752
2003/0157834 A1 * 8/2003 Ichio ..... 439/595
2005/0090148 A1 * 4/2005 Sagawa et al. ..... 439/595

FOREIGN PATENT DOCUMENTS

JP 2001-326011 11/2001

* cited by examiner

*Primary Examiner*—Alexander Gilman
(74) *Attorney, Agent, or Firm*—Edwards Angell Palmer & Dodge LLP

(57) ABSTRACT

The terminal locking lance includes a supported part supported by a top wall of a standing wall and a lance locking projection projected from the top wall of the standing wall. The standing wall includes a standing wall locking projection formed on the top wall at a further rear end side in an insertion direction of a terminal fitting than the lance locking projection, and opposed to the lance locking projection. When the lance locking projection is pulled toward the rear end in the insertion direction, the standing wall locking projection is locked with the lance locking projection.

2 Claims, 5 Drawing Sheets

CONNECTOR HOUSING

CROSS REFERENCE TO RELATED APPLICATIONS

This application is on the basis of Japanese Patent Application No. 2006-243668, the contents of which are hereby incorporated by reference.

BACKGROUND OF THE INVENTION

1. Field of the Invention

The present invention relates to a connector housing, in particular, a connector housing having a bottom wall forming terminal receiving chambers for receiving terminal fittings, a plurality of standing walls standing from the bottom wall in a direction of inserting the terminal fittings to the terminal receiving chambers, and terminal locking lances formed between the standing walls, and having locking parts for locking the terminal fittings received in the terminal receiving chambers.

2. Description of the Related Art

As a conventional connector housing, for example, a connector housing shown in FIG. 6 is disclosed in Japanese Published Patent Application No. 2001-326011. As shown in FIG. 6, a plurality of terminal receiving chambers 100 is formed in the connector housing. A terminal locking lance 101 for locking the terminal fitting received in the terminal receiving chamber 100 is formed in each terminal receiving chamber 100. The terminal locking lance 101 is formed at a top end of a bottom wall 102 partitioning the terminal receiving chambers 100 in a direction Y1 of inserting the terminal fitting to the terminal receiving chamber 100. The terminal locking lance 101 is supported at one side, and a top end of the other side of the terminal locking lance 101 is a free end. The terminal locking lance 101 is resiliently deformed in an up-down direction Y2.

When the terminal fitting is inserted into the terminal receiving chamber 100 through a terminal insertion hole 103, and a tip of the terminal fitting abuts on the terminal locking lance 101, the terminal locking lance 101 is bent downward.

By the way, a technique for downsizing a connector housing by thinning a thickness of the terminal locking lance 101 in the up-down direction Y2 is proposed. As shown in FIG. 6, conventionally, a locking part 104 for locking the terminal fitting and a lock releasing part 105 for releasing the lock with a tool 106 are arranged in the up-down direction Y2. However, as shown in FIG. 7, a short connector housing in which the locking part 104 and the lock releasing part 105 are arranged in a width direction Y3 is proposed. Further, a slit 107 is formed on the terminal locking lance 101 shown in FIG. 7, so that the terminal locking lance 101 is easily bent in the up-down direction Y2.

There is a problem that when the terminal fitting is pulled toward a rear end of the connector housing in the insertion direction Y1, and the terminal locking lance 101 is pulled toward the rear end, the terminal locking lance 101 may buckle. Particularly when the connector housing is short, or a slit 107 is formed on the connector housing, the terminal locking lance 101 may buckle with a lower force for pushing the connector housing toward the rear end thereof.

Accordingly, an object of the present invention is to provide a connector housing of which terminal locking lance is hard to buckle.

SUMMARY OF THE INVENTION

In order to attain the object, according to the present invention, there is provided a connector housing including:

a bottom wall having terminal receiving chambers for receiving terminal fittings;

a plurality of standing walls standing from the bottom wall perpendicular to a direction of inserting the terminal fittings to the terminal receiving chambers; and terminal locking lances formed between the standing walls, and having locking parts for locking the terminal fittings received in the terminal receiving chambers, wherein each terminal locking lance includes a supported part supported by a top wall of the standing wall, and a lance locking projection projected from the top wall of the standing wall, wherein the standing wall includes a standing wall locking projection disposed on the top wall at a rear end side in a direction of inserting the terminal fitting so as to face the lance locking projection, wherein when the terminal locking lance is pulled to the rear end in the direction of inserting the terminal fitting, the standing wall locking projection locks the lance locking projection.

Preferably, the terminal receiving chambers are arranged parallel to each other, each terminal receiving chamber has the terminal locking lance, and each standing wall locking projection is disposed so as to be inserted into a slit between the adjacent terminal locking lances.

These and other objects, features, and advantages of the present invention will become more apparent upon reading of the following detailed description along with the accompanied drawings.

DETAILED DESCRIPTION OF THE PREFERRED EMBODIMENTS

A connector housing according to an embodiment of the present invention will be explained with reference to FIGS. 1 to 5.

Figure 1:
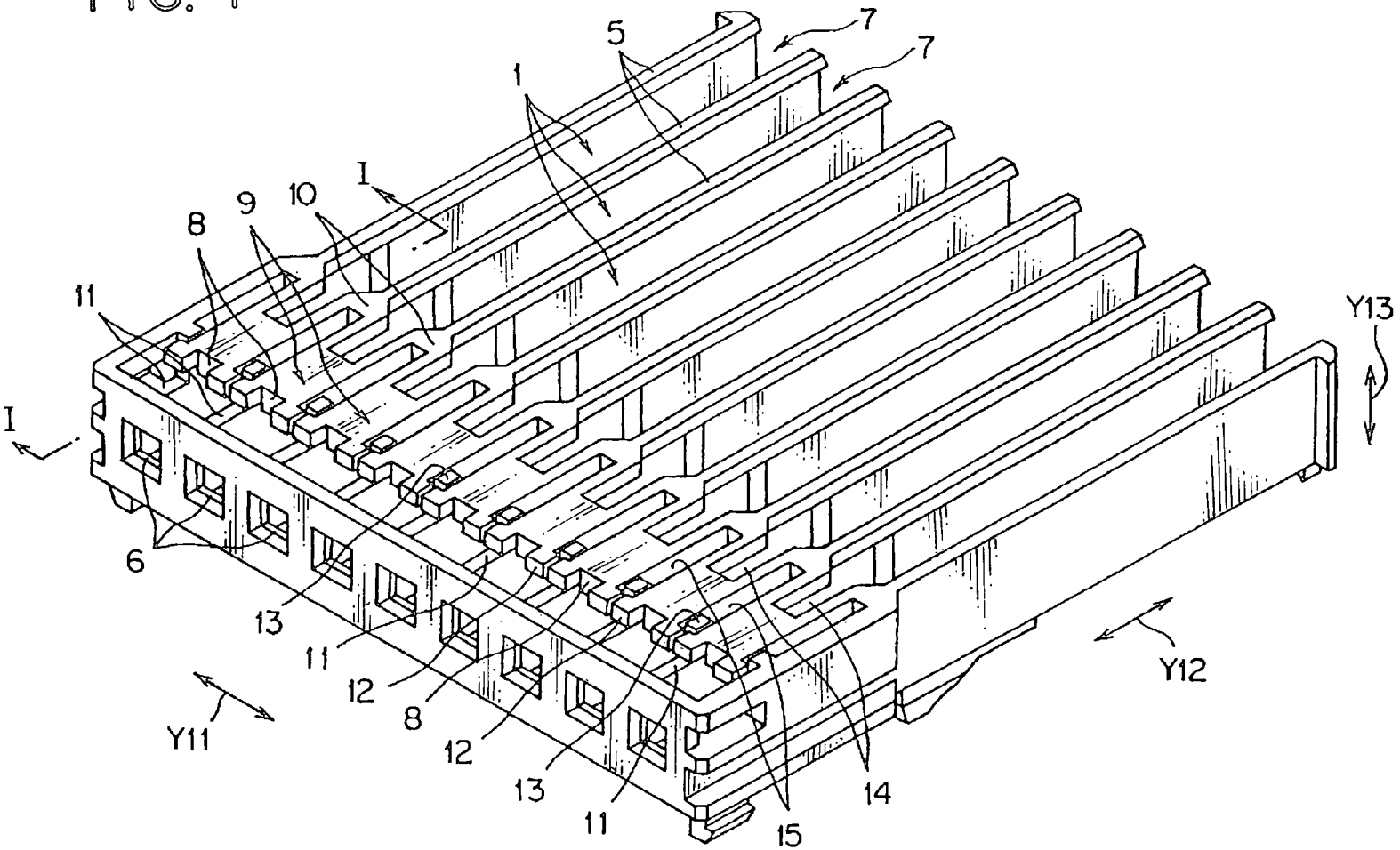
FIG. 1 is a perspective view showing a connector housing according to an embodiment of the present invention.
Figure 2:
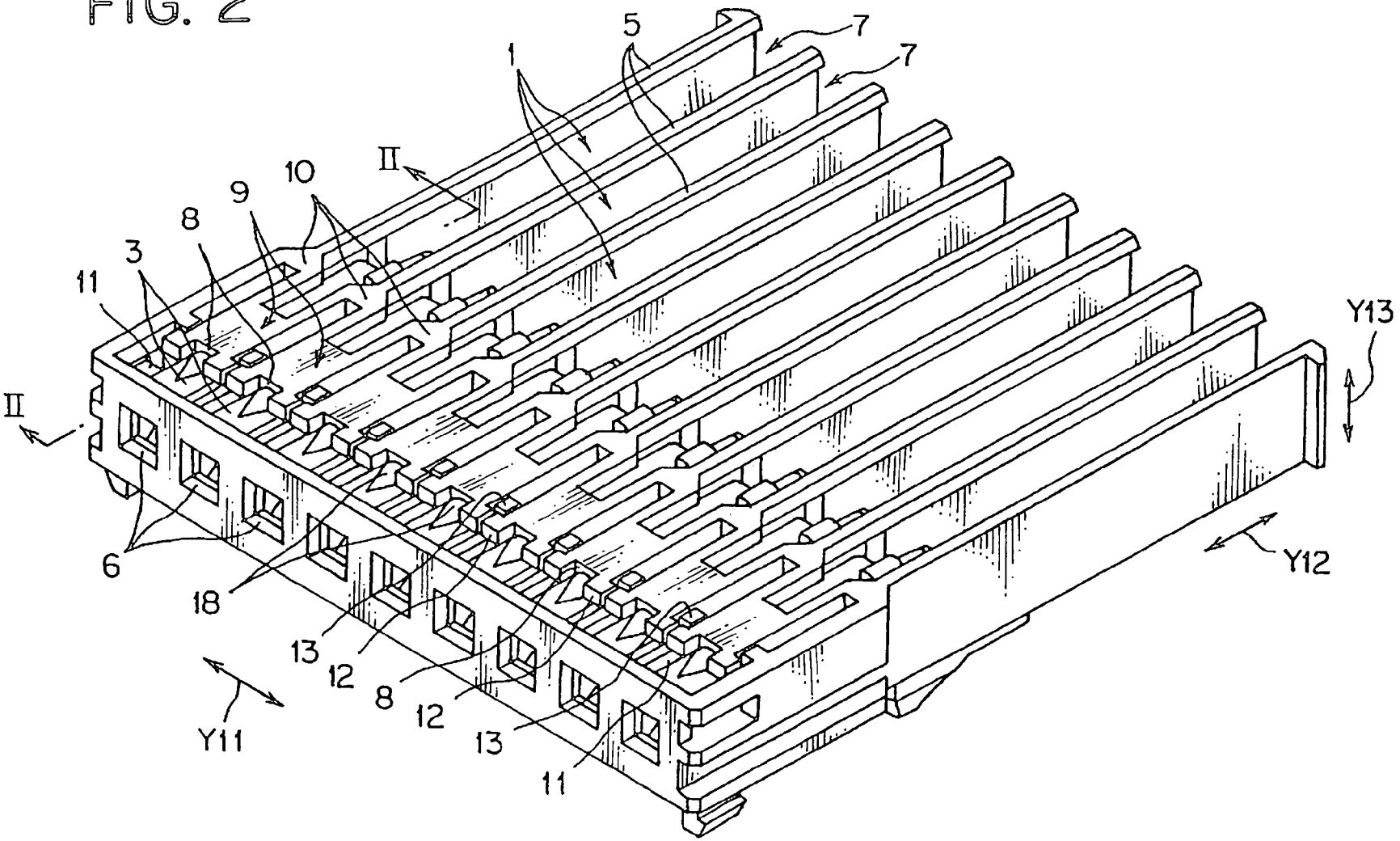
FIG. 2 is a perspective view showing the connector housing of FIG. 1 receiving terminal fittings.
Figure 3:
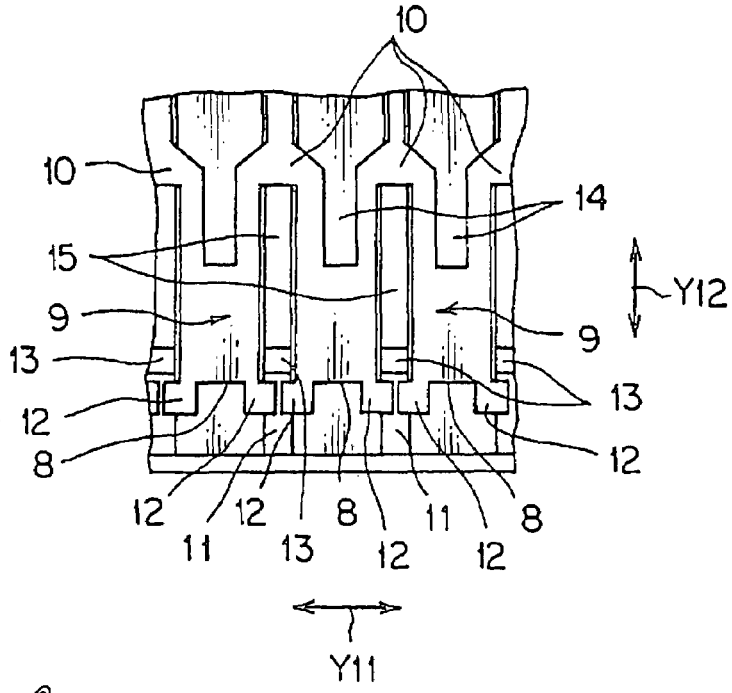
FIG. 3 is a top view of the connector housing of FIG. 1.
Figure 5:
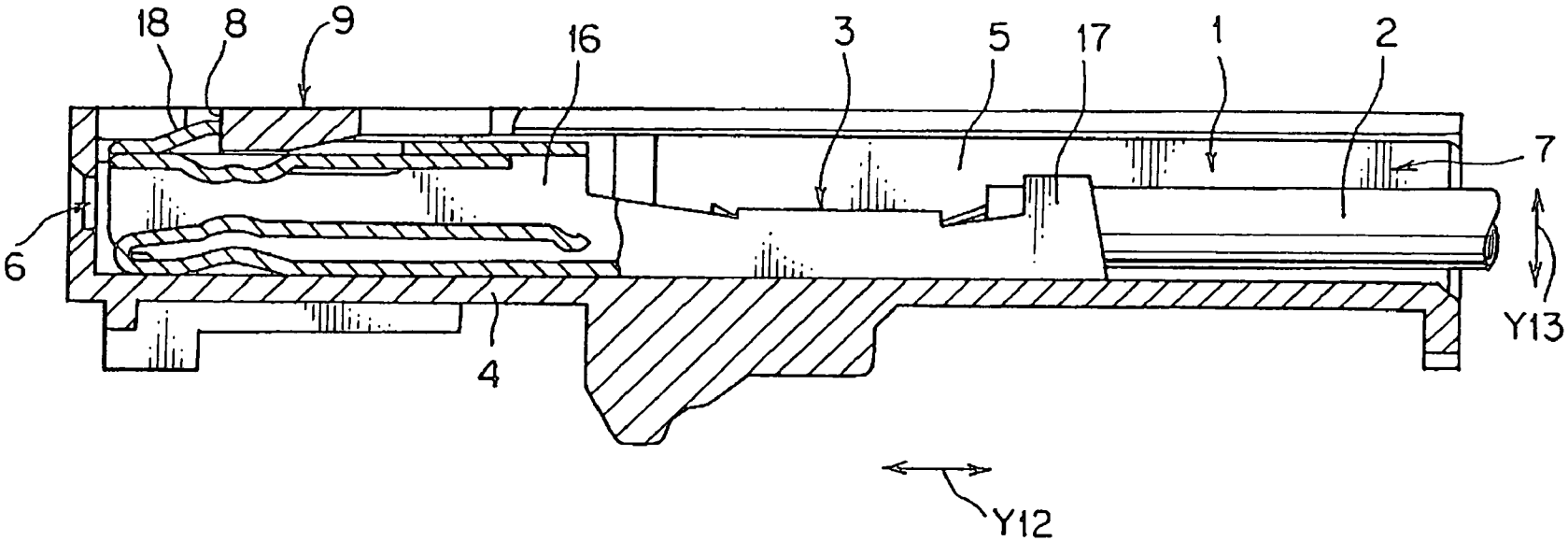
FIG. 5 is a sectional view taken on line II-II of FIG. 2.

As shown in FIG. 1, in the connector housing, for example, nine terminal receiving chambers 1 are arranged in a direction Y1. As shown in FIG. 5, each terminal receiving chamber 1 receives a female type terminal fitting 3 fixed to an end of an electric wire 2. The connector housing is formed in a substantially box shape, and includes a bottom wall 4 and a plurality of standing walls 5 standing from the bottom wall 4 in a direction Y12 of inserting the terminal fitting into the terminal receiving chamber 1. The standing wall 5 partitions the adjacent terminal receiving chambers 1 in the direction Y11. The terminal receiving chamber 1 is surrounded by the bottom wall 4 and the standing walls 5.

Figure 4:
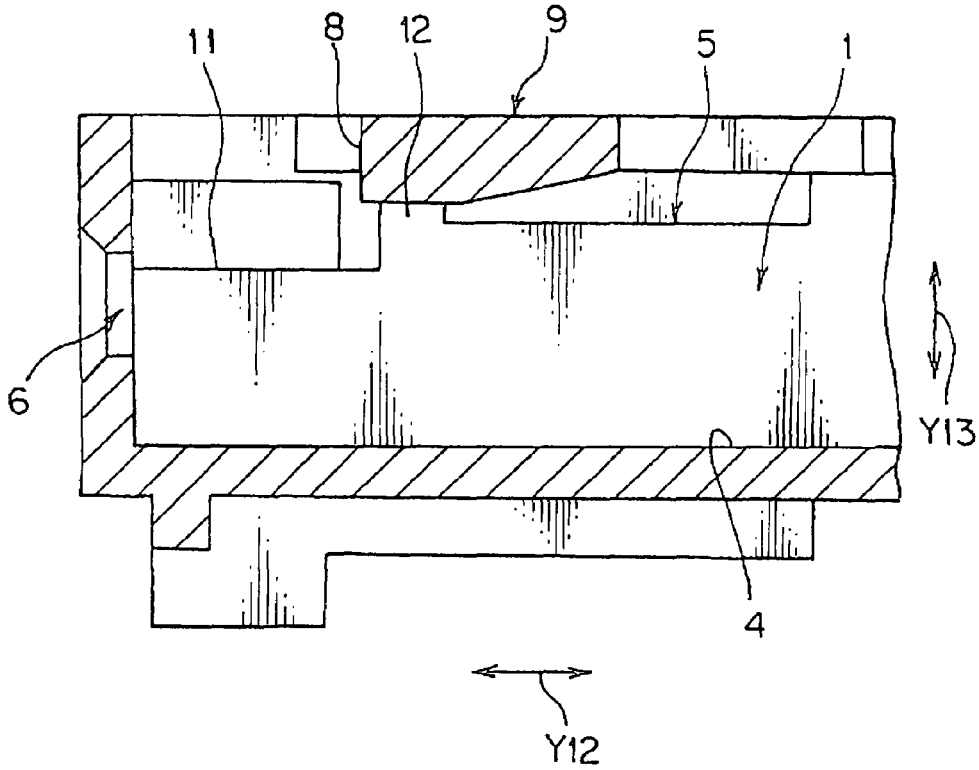
FIG. 4 is a sectional view taken on line I-I of FIG. 1.

As shown in FIGS. 4 and 5, a mating terminal insertion hole 6 for inserting a male terminal (not shown) to be fitted to the terminal fitting 3 is formed at a top end of the connector housing in the insertion direction Y12. A receiving terminal insertion hole 7 for inserting the terminal fitting 3 into the terminal receiving chamber 1 is formed at a rear end of the connector housing in the insertion direction Y12.

The connector housing includes a terminal locking lance 9 having a locking part 8 to lock the terminal fitting 3 received in the terminal receiving chamber 1. The locking part 8 is formed at a top end of the terminal locking lance 9 in the insertion direction Y12.

Each terminal locking lance 9 includes a supported part 10 at a rear end thereof in the insertion direction Y12. The supported part 10 is supported at a top wall 11 of the standing wall 5 partitioning the terminal receiving chamber 1. Thus, the locking part 8 of the terminal locking lance 9 is disposed over the top wall 11 of the standing wall 5. Incidentally, the top wall 11 of the standing wall 5 is a wall opposed to the bottom wall 4 of the standing wall 5 in a standing direction Y13. As shown in FIG. 4, the terminal locking lance 9 projects toward the bottom wall 4 as the terminal locking lance 9 extends toward the top end thereof.

Further, the terminal locking lance 9 includes a lance locking projection 12 mounted on the top wall 11 of the standing wall 5 at the top end of the terminal locking lance 9. The lance locking projection 12 is disposed at the further top end of the terminal locking lance 9 than the locking part 8. Further, the standing wall 5 includes a standing wall locking projection 13 for locking the lance locking projection 12 when the terminal locking lance 9 is pulled toward the rear end in the insertion direction Y12. The standing wall locking projection 13 is formed on the top wall 11 at the further rear end of the terminal locking lance 9 in the insertion direction Y12 than the lance locking projection 12, and opposed to the lance locking projection 12. Consequently, the lance locking projection 12 and the standing wall locking projection 13 are opposed to each other with a gap in the insertion direction Y12. Further, the lance locking projection 12 is formed at the top end side in the insertion direction Y12, and the standing wall locking projection 13 is formed at the rear end side in the insertion direction Y12.

Slits 14, 15 are formed on the terminal locking lance 9 in the insertion direction Y12. The slit 14 is formed in the center of the terminal locking lance 9 in the direction Y11 at the rear end side of the terminal locking lance 9. The slit 15 is formed between the adjacent terminal locking lances 9 at the top end side of the terminal locking lance 9. Owing to the slits 14, 15, the terminal locking lance 9 is easily bendable in the standing direction Y13. The standing wall locking projection 13 is inserted into the slit 15.

Next, a structure of the terminal fitting 3 will be explained. As shown in FIG. 5, the terminal fitting 3 includes a tubular part 16 into which a male type mating terminal fitting 3 is inserted, and a connecting part 17 crimpingly connected to the electric wire 2. A hollow terminal locking projection 18 to be locked with the terminal locking lance 9 is formed on the tubular part 16. The terminal locking projection 18 has a taper of which height becomes higher as the terminal locking projection 18 extends toward the rear end.

Next, a way to receive the terminal fitting 3 in the terminal receiving chamber 1 of the connector housing will be explained. The terminal fitting 3 is inserted into the terminal receiving chamber 1 through the receiving terminal insertion hole 7 formed on the rear end of the connector housing, and moved toward the top end of the connector housing along the bottom wall 4. When the terminal locking projection 18 is moved to the terminal locking lance 9 and to the further top end side than the slit 14, the terminal locking lance 9 is bent upward.

At this time, the lance locking projection 12 and the standing wall locking projection 13 do not interfere with each other, and the standing wall locking projection 13 does not interfere with the insertion of the terminal fitting 3. Namely, a gap in the insertion direction Y12 is formed between the lance locking projection 12 and the standing wall locking projection 13 so as to allow the terminal locking lance 9 to be bent upward when the terminal fitting 3 is inserted into the terminal receiving chamber 1.

When the terminal fitting 3 is further moved and the terminal locking projection 18 reaches the further top end side than the locking part 8 of the terminal locking lance 9, the terminal locking lance 9 is restored downward, and the locking part 8 of the terminal locking lance 9 is locked with the terminal locking projection 18 of the terminal fitting 3. Thus, even when the terminal fitting 3 is pulled toward the rear end in the insertion direction Y12, the terminal fitting 3 does not come out from the terminal receiving chamber 1 because the terminal locking projection 18 is locked with the locking part 8 of the terminal locking lance 9.

Further, as described the above, the lance locking projection 12 formed on the terminal locking lance 9 is disposed at the top end side, and the standing wall locking projection 13 formed on the standing wall 5 is disposed at the rear end side in the insertion direction Y12. The lance locking projection 12 and the standing wall locking projection 13 are opposed to each other in the insertion direction Y12. Therefore, when the terminal fitting 3 received in the terminal receiving chamber 1 is pulled toward the rear end in the insertion direction Y12, the lance locking projection 12 abuts on the standing wall locking projection 13, and a force to move toward the top end in the insertion direction Y12 is added to the terminal locking lance 9. Resultingly, the pulling force is canceled, and the terminal locking lance 9 is hard to be buckled. Namely, in the connector housing having the above described structure, the terminal locking lance 9 is not buckled, and a holding power of the terminal locking lance 9 for holding the terminal fitting 3 is not reduced.

Further, according to the above, because the standing wall locking projection 13 is inserted into the slit 15 formed between the adjacent terminal locking lances 9, the terminal locking lance 9 is easy to be buckled due to the pulling force. However, because the lance locking projection 12 abuts on the standing wall locking projection 13, the pulling force is canceled. Resultingly, the terminal locking lance 9 is hard to be buckled.

Incidentally, according to this embodiment, nine terminal receiving chambers 1 are formed on the connector housing. However, the present invention is not limited to this. For example, one terminal receiving chamber 1 may be formed. More than nine terminal receiving chambers 1 may be formed.

Further, according to this embodiment, the lance locking projection 12 is formed on both top walls 11 of the standing walls 5 partitioning the terminal receiving chamber 1. However, the present invention is not limited to this. The lance locking projection 12 may be formed on at least one top wall 11 of the standing wall 5. However, when the lance locking projection 12 formed on both top walls 11, the terminal locking lance 9 is harder to be buckled.

Figure 6:
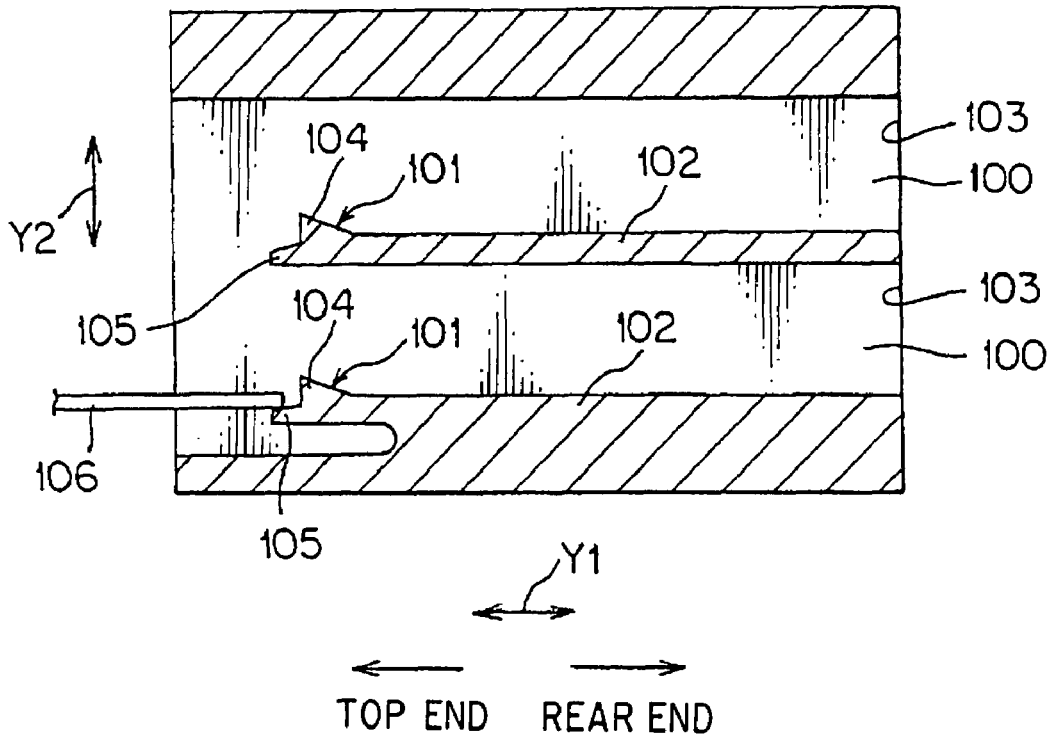
FIG. 6 PRIOR ART
FIG. 6 is a sectional view showing a conventional connector.
Figure 7:
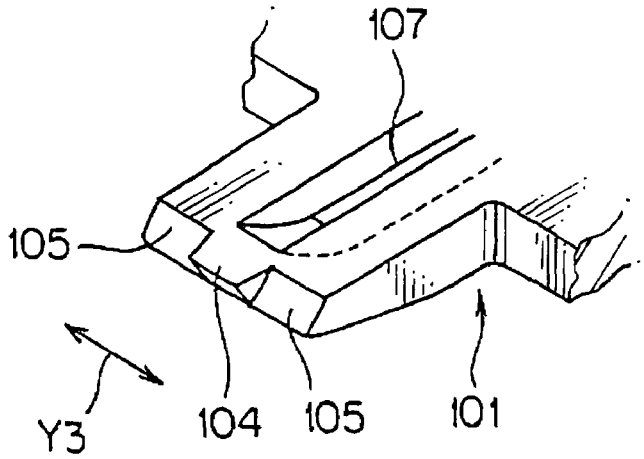
FIG. 7 PRIOR ART
FIG. 7 is a perspective view showing a conventional terminal locking lance.

Further, according to this embodiment, the lance locking projection 12 is formed on the terminal locking lance 9 that is easily buckled owing to a low shaped connector housing having slits 14, 15. However, the present invention is not limited to this. For example, as shown in FIG. 6, the lance locking projection 12 may be formed on the terminal locking lance 9 that is hard to be buckled. In this case, the terminal locking lance 9 is further harder to be buckled.

Further, according to this embodiment, the lance locking projection 12 is formed at the top end of the terminal locking lance 9. However, the present invention is not limited to this. The lance locking projection 12 may be formed on anywhere as long as it is at the further top side than the supported part 10.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A connector housing comprising:

a bottom wall having terminal receiving chambers for receiving terminal fittings;

a plurality of standing walls standing from the bottom wall perpendicular to a direction of inserting the terminal fittings to the terminal receiving chambers; and terminal locking lances formed between the standing walls, and having locking parts for locking the terminal fittings received in the terminal receiving chambers, wherein each terminal locking lance includes a supported part supported by a top wall of the standing wall, and a lance locking projection projected from the top wall of the standing wall, wherein the standing wall includes a standing wall locking projection disposed on the top wall at a rear end side in a direction of inserting the terminal fitting so as to face the lance locking projection, wherein when the terminal locking lance is pulled to the rear end in the direction of inserting the terminal fitting, the standing wall locking projection locks the lance locking projection.

2. The connector housing as claimed in claim 1, wherein the terminal receiving chambers are arranged parallel to each other, each terminal receiving chamber has the terminal locking lance, and each standing wall locking projection is disposed so as to be inserted into a slit between the adjacent terminal locking lances.

* * * * *

UNITED STATES PATENT AND TRADEMARK OFFICE

CERTIFICATE OF CORRECTION

PATENT NO. : 7,455,551 B2
APPLICATION NO. : 11/898018
DATED : November 25, 2008
INVENTOR(S) : Nobuyuki Sakamoto et al.

It is certified that error appears in the above-identified patent and that said Letters Patent is hereby corrected as shown below:

TITLE PAGE:

Please correct the second named inventor as it appears in the Official Filing Receipt as follows:

~~Yomihiko~~ Tomihiko Nagayoshi

Signed and Sealed this

Third Day of February, 2009

John Doll

JOHN DOLL
*Acting Director of the United States Patent and Trademark Office*